US006474647B1

(12) United States Patent
Zakhar

(10) Patent No.: US 6,474,647 B1
(45) Date of Patent: Nov. 5, 2002

(54) COMPETITIVE GAMBLING BOARD GAME

(76) Inventor: Ronald A. Zakhar, 1848 Mariposa Ave., Apt. #105, Los Feliz, CA (US) 90028

( * ) Notice: Subject to any disclaimer, the term of this patent is extended or adjusted under 35 U.S.C. 154(b) by 0 days.

(21) Appl. No.: 09/618,397

(22) Filed: Jul. 18, 2000

(51) Int. Cl.[7] ..... A63F 3/00

(52) U.S. Cl. ..... 273/292; 273/430; 273/274; 273/287

(58) Field of Search ..... 273/236, 243, 273/292, 430, 431, 274, 287

(56) References Cited

U.S. PATENT DOCUMENTS 3,936,054 A * 2/1976 Garcia
4,585,233 A * 4/1986 Wilson
4,930,789 A * 6/1990 Harris et al.
5,169,154 A * 12/1992 Borghi
5,228,698 A * 7/1993 Dubarry, Jr.
5,360,216 A * 11/1994 Counterman
5,377,990 A * 1/1995 Seeneh-Sullivan
5,679,000 A * 10/1997 Joyce
D402,330 S * 12/1998 White
5,876,211 A * 3/1999 Schmoyer et al.
6,209,871 B1 * 4/2001 Butler
6,279,909 B1 * 8/2001 Alexander, II et al.
6,286,833 B1 * 9/2001 Collins

* cited by examiner

*Primary Examiner*—Paul T. Sewell
*Assistant Examiner*—Nini F. Legesse
(74) *Attorney, Agent, or Firm*—Albert O. Cota

(57) ABSTRACT

A competitive gambling board game (10), also known as ZAKIT™, designed to simulate the gambling ambience of a Las Vegas casino. The game is played by two or more players on a game board (12) having several spaces including a start space and a finish space. On these spaces various characters (50), who own possessions, are moved in accordance with the point established when a first player rolls a pair of dice (46). After the point is established, the other players can place bets on the rolled number or another selected number and the first player moves his/her character (50) the amount of spaces the rolled point is worth. When any player lands on another player's character he/she selects a character possession card (52) from the landed character (50). If a seven is rolled a trivia or a true or false question is answered or a ZAKIT™ or Bust roll may be taken. If the trivia question is answered correctly a bonus is earned. If the ZAKIT™ or Bust is selected a bonus round can be taken. If a 2 or 12 is rolled a "You're So Money Honey" card (62) is selected which provides a bonus; if a 3 or 11 is rolled a "NO JACK BABY" (64) card is selected and the player must pay a fine. The game is completed when the first player crosses the finish line on the game board (12). The player who has accumulated the most money wins the game.

7 Claims, 19 Drawing Sheets

ZAKIT ! CHARACTER BIO.

THREE OF A KIND

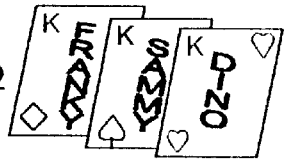

PERSONAL POSSESSIONS

| | |
|---|---|
| LOADED DICE = | $ 1100. |
| V.I.P. PASSWORD = | $ 500. |
| LIQUOR CABINET INVENTORY = | $ 1400. |
| LIQUOR CABINET LOCK COMBONATION = | $ 1500. |
| BLACK BOOK WIT ALL DA BROADS = | $2500. |
| TOTAL $ IN POSSESSIONS= | $ 7000. |

THESE THREE GUYS HAPPEN TO BE AN ARIES, LEO AND SAGITTARIUS WITH GEMINI RISING. IF YOU BELIEVE IN THIS STUFF DESE GUYS ARE WITTY, PROUD, THEATRICAL AND A CHAMELEON. ONCE THEY'RE ON FIRE GOOD LUCK PUT'N DEM OUT.

FAMILY * EVERYONE WHO WORKS FOR THEM
LIKES * THEIR DRINKS COLD
DISLIKES * HEARING THE WORD NO
FAVORITE FOOD * OSSO BUCCO AND SPAGHETTI AND MEATBALLS
FAVORITE DRINKS * SAMBUCA,JD ON THE ROCKS AND GRAPPA
LUCKY CHARM * THE FIRST PAIR OF DICE THEY EVER ROLLED
FAVORITE COLORS * GREEN, WHITE AND RED
HEARD MOST OFTEN SAYING * LET IT RIDE, DOUBLE OR NOTH'N AND HIT ME
LIFE DREAM * TO OWN THEIR OWN CASINO
FAVORITE GAME *WHATEVER YOU'RE PLAYING
FAVORITE SONG * LUCK BE A LADY
HOBBIES * PLAYING GAMES AND SINGING SONGS

FIG. 13

ZAKIT ! CHARACTER BIO.

THE QUEEN OF HEARTS

PERSONAL POSSESSIONS

| | |
|---|---|
| RACE HORSE "SUNSHINE GIRL" = | $2500. |
| SAFETY DEPOSIT BOX KEY = | $1500. |
| IRISH BUTLER "JACK O'SPADES"= | $1100. |
| LIMO DRIVER "ACE" = | $ 500. |
| DANCE'N SHOES = | $ 1400. |
| TOTAL $ IN POSSESSIONS = | $ 7000. |

OUR QUEEN OF HEARTS IS A TAURUS WITH A LIBRA RISING. OUR LADY CELEBRATES AND DEMANDS THE GOOD LIFE ! SHE IS MANNERLY, PLEASANT, SENSUAL AND ACQUISITIVE.

FAMILY* THE ROYAL ONE, NATURALLY
LIKES * THOSE THAT KNOW THEIR PLACE
DISLIKES * THOSE THAT DON' T
FAVORITE FOOD * PATE AND SWEET ROLLS
FAVORITE DRINK * HOT TEA WITH A SPLASH OF LUV
LUCKY CHARM * 17 CARAT BULGARI RUBY HEART
FAVORITE COLOR * ALL SHADES OF RED
HEARD MOST OFTEN SAYING * " LET THEM EAT CAKE!"
LIFE'S DREAM * FOR SUNSHINE GIRL TO WIN THE TRIPLE CROWN
FAVORITE GAME * BACCARAT
FAVORITE SONG * DESPERADO
HOBBIES * SPENDING TIME IN THE ROSE GARDEN
FAVORITE HOLIDAY * SAINT VALENTINE'S DAY

FIG. 14

ZAKIT ! CHARACTER BIO.

2ND HAND ROSE

PERSONAL POSSESSIONS

| | |
|---|---|
| HER PET POOCH "BUTTONS" = | $ 2500. |
| GOLD TOOTH FILLING = | $ 500. |
| A PEARL HANDLED PISTOL = | $ 1500. |
| A VINTAGE MINK STOLE = | $ 1100. |
| ONE HELL OF A COOK BOOK = | $ 1400. |
| TOTAL $ IN POSSESSIONS = | $7000. |

OUR MILLION DOLLAR BAG LADY IS A CAPRICORN WITH A VIRGO RISING. THE LITTLE TRAMP IS THRIFTY, SENSIBLE, WISE AND ORGANIZED , SHE KNOWS HOW TO SAVE A BUCK AND THAT'S WHY THE LADY IS A TRAMP

CLAIM TO FAME * BOUGHT A VAN GOGH PAINTING AT THE THRIFT STORE AND SOLD IT FOR 1 MILLION DOLLARS

FAMILY * BUTTONS AND HER PAL LONG SHOT LOUIE

LIKES * CONVENTIONS AND CONCERTS

DISLIKES * ALLEY CATS & PAY'N TAXES.

FAVORITE FOOD * LEFT OVERS

FAVORITE DRINK * FREE

LUCKY CHARM * LONG SHOT LOUIE

FAVORITE COLORS * THE COLORS OF A SUNRISE

IS HEARD MOST OFTEN SAYING *"THE STREETS ARE FILLED WITH GOLD"

LIFE DREAM * TO WORK A GREAT DEAL AT THE PAWN SHOP.

FAVORITE GAME * KENO

FAVORITE SONG * THE LADY IS A TRAMP

FIG. 15

ZAKIT ! CHARATER BIO.

FATHER O'SLEVIN

PERSONAL POSSESSIONS

| | |
|---|---|
| THE HOLY GRAIL = | $2500. |
| LAST SUNDAYS OFFERING = | $1100. |
| UNLIMITED SUPPLY OF WINE = | $ 1400. |
| AUTOGRAPHED PICTURE WITH THE POPE = | $1500. |
| 72' 4 DOOR IMPERIAL = | $500. |
| TOTAL $ IN POSSEESSIONS = | $7000. |

OUR FATHER IS A PISCES WITH SAGITTARIUS RISING. THERE ARE TWO CALLS YOU CAN ALWAYS COUNT ON HIM MAKING ONE TO THE MAN UPSTAIIRS AND THE OTHER TO HIS BOOKIE. HE IS SENSITIVE, RIGHTEOUS, OPEN HANDED AND FREE SPIRITED.

FAMILY * ALL THE IRISH IN THE WORLD
LIKES * HOLIDAY OFFERINGS AND FUND RAISERS
DISLIKES * SNAKE EYES AND BOX CARS
FAVORITE FOOD * CORNED BEEF AND CABBAGE
FAVORITE DRINK * IRISH WHISKY
FAVORITE COLOR * KELLY GREEN
LUCKY CHARM * SISTER MARY CATHRINE
FAVORITE FILM * ANTHING WITH FATHER FLANAGAN
IS HEARD MOST OFTEN SAYING * " GIVE A MAN DICE AND HE WILL EAT FOR A DAY. TEACH HIM TO GAMBLE AND HE WILL EAT FOREVER. "
FAVORITE GAME * THE PONIES
FAVORITE SONG * SPIRIT IN THE SKY
HOBBIES * THE PONIES
FAVORITE HOLIDAY * SAINT PATTY'S DAY

FIG. 16

ZAKIT ! CHARATER BIO.

JD

PERSONAL POSSESSION

| | |
|---|---|
| STOCK MARKET TIPS = | $2500. |
| GOLF CLUBS = | $1500. |
| SUPER DELUXE STILL CAMERA = | $1400. |
| PHONE NUMBER TO ESCORT SERVICE = | $1100. |
| HIS PET PRAIRIE DOG = | $ 500. |
| TOTAL $ IN POSSESSIONS = | $7000. |

OUR BOY JD IS A VIRGO WITH PISCES RISING. HE IS ONE WHO THROWS HIS HAT OVER THE FENCE. HE IS MODEST. FACTUAL AND EASYGOING.

FAMILY * JD COMES FROM A LONG LINE OF JAPANESE FARMERS.
LIKES * FAST FOOD, ONE HOUR FILM PROCESSING, AND THE STOCK MARKET.
DISLIKES * DRIVING,WOMEN AN CHILDREN WHO SPEAK BEFORE THEY ARE SPOKEN TO.
FAVORITE FOODS * FAST, GREASY, SALTY AND SPICY.
FAVORITE DRINK * KAMIKAZEES
GOOD LUCK CHARM * HIS PET PRAIRIE DOG
FAVORITE COLOR * SILVER
FAVORITE GAME * PAI GOW
HEARD MOST OFTEN SAYING * " IF YOU CAN'T BEAT'EM JOIN 'EM "
FAVORITE SONG * CAN'T BUY ME LOVE
LIFE DREAM * RETIRING YOUNG

FIG. 17

ZAKIT ! CHARACTER BIO.

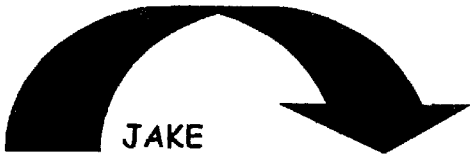

PERSONAL POSSESSIONS

| | |
|---|---|
| HOT SPORT TIPS FOR THE WEEK = | $2500. |
| CUBAN CIGARS SHIPPED IN FROM THE WHITE HOUSE = | $ 500. |
| RIDING LAWN MOWER = | $1400. |
| LUCKY HAT = | $1100. |
| SATELITE DISH = | $1500. |
| TOTAL $ IN POSSESSIONS = | $7000. |

OUR BOOKIE BIG JAKE IS AN AQUARIUS WITH ARIES RISING. HE IS A VISIONARY, INDEPENDENT, CHARITABLE, CURIOUS, PLUCKY AND YOU CAN BET ON THAT !

FAMILY * "THAT'S NONE OF YOUR BUSINESS !"
LIKES * PAY PHONES AND DEGENERATE GAMBLERS
DISLIKES * CANARIES AND RATS
FAVORITE DRINK * STIFF
FAVORITE FOOD * WHAT EVER MAMA IS COOKING
LUCKY CHARM * HIS FIRST SILVER DOLLAR HE EVER WON
FAVORITE COLOR * ORANGE
IS HEARD MOST OFTEN SAYING * DO YOU KNOW WHO I WORK FOR ?
LIFE DREAM * TO THROW A PRIZE FIGHT
FAVORITE GAME * SLOTS
FAVORITE SONG * EYE OF THE TIGER

FIG. 18

ZAKIT ! CHARACTER BIO.

JIMMY BAG O' DONUTS

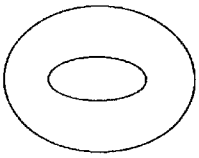

PERSONAL POSSESSIONS

| | |
|---|---|
| UNLIMITED SUPPLY OF TUMS = | $ 500. |
| THE CHIEF OF POLICE = | $1500. |
| INSIDE CONNECTIONS = | $1400. |
| HIS SIDE KICK MONKEY NICK = | $1100. |
| KEYS TO THE CITY = | $2500. |
| TOTAL $ IN POSSESSIONS = | $7000. |

OUR MAYOR IS A LEO WITH SCORPIO RISING.
THIS LITTLE MAN WALKS WITH A BIG STICK .
HE'S A PROUD, AUDACIOS,
LOYAL AND COMMITTED LEADER. IF THERE'S
ANYTHING YOU NEED, HE'LL TAKE CARE OF IT.

CLAIM TO FAME * THE ONLY HUNGARIAN GYYPSY WHO WAS EVER ELECTED MAYOR
FAMILY * A BUVARIANCREAM PUFF AND 9 LITTLE MUNCHKINS.
LIKES * GETT'N HIS PALM GREASED
DISLIKES * GETTING HIS PICTURE TAKEN
FAVORITE FOOD * HUNGARIAN GOULASH
FAVORITE DRINK * "WHATEVER YOU GOT BABE!"
LUCKY CHARM * POCKET KNIFE
FAVORITE COLOR * BALOU
LIFE DREAM * TO WIN THE ANNUAL POKER TOURNAMENT AT CAESARS PALACE,LAS VEGAS
FAVORITE GAME * 5 CARD STUD
HEARD MOST OFTEN SAYING *" WHATEVER YOU GOT BABE!"
FAVORIT SONG * IF I WAS KING FOR A DAY
HOBBIE * MAKING THOSE DONUTS

FIG. 19

ZAKIT ! CHARACTER BIO.

COOKIE DOLL

HEY DOLL

PERSONAL POSSESSIONS

| | |
|---|---|
| PINK BOA = | $ 500. |
| STAGE WARDROBE = | $ 1500. |
| THE ROCK ON HER FINGER = | $ 2500. |
| ELVIS PRESLEY HANKY = | $ 1400. |
| BACKSTAGE PASS = | $ 1100. |
| TOTAL $ IN POSSESSIONS = | $ 7000. |

OUR SHOWGIRL JUST SO HAPPENS TO BE A LIBRA WITH SCORPIO RISING ALL THE WAY TO THE TOP. SHE LOVES TO ENTERTAIN, ALWAYS KNOWS BEST AND EXPECTS THE BEST. SHE IS LOVING, PASSIONATE, CREATIVE AND GREGARIOUS.

FAMILY * ANYONE THAT CAN CUT A RUG
LIKES * HIGH ROLLERS, JUMP'N JIVE AND LOOK'N GOOD
DISLIKES * PAYING FOR DINNER AND CAB RIDES
FAVORITE DRINK * PINK LADY WITH A TWIST
LUCKY CHARM * HER OWN CHARM
FAVORITE COLOR * PINK
IS HEARD MOST OFTEN SAYING * THE WORLD IS MY STAGE AND I'M DANCIN
LIFE DREAM * DOING THE CAN CAN IN GAY PAREE
FAVORITE GAMES * WHEEL OF FORTUNE SLOTS
FAVORITE SONG * THE COPACABANA
HOBBIES * JIMMY BAG O'DONUTS.

FIG. 20

ZAKIT ! CHARACTER BIO.

SCHMOKEY

PERSONAL POSSESSIONS

| | |
|---|---|
| HIS FRESH LEATHER COAT = | $1100. |
| PINKY RING = | $1400. |
| WALKING STICK = | $ 500. |
| STOCK SHARES IN MOTEL HOTEL 8 = | $2500. |
| BOOTSY COLLIN COLLECTION = | $1500. |
| TOTAL $ IN POSSESSIONS = | $7000. |

OUR SMOOTH LOUNGE SINGER IS A CANCER WITH GEMINI RISING. HE IS PERSISTANT, PROTECTIVE, NURTURING,CHARMING, ANALYTICAL AND ALWAYS STIMULATING.

FAMILY * EVERYONE CALLED BABY
RESIDENCE * MOTEL HOTEL 8
LIKES * FULL MOONS AND RAINY DAYS
DISLIKES * RAIN COATS
FAVORITE DRINK * FRUIT PUNCH
FAVORITE FOOD * MICKY D'S
LUCKY CHARM * YOUR MAMA
IS HEARD MOST OFTEN SAYING * "AINT NOTHING LIKE THE REAL THING"
FAVORITE COLOR * BROWN
FAVORITE GAME * BLACKJACK
LIFE DREAM * BEING A LOUGE SINGER AT THE KITTY KAT KASINO
FAVORITE SONG * YOU'RE MY FIRST, MY LAST, MY EVERYTHING

FIG. 21

COMPETITIVE GAMBLING BOARD GAME

TECHNICAL FIELD

The invention pertains to the general field of board games and more particularly to a competitive gambling board game having pieces which move upon spaces on the board. The number of spaces moved is determined by a pair of dice and each space describes an action to be taken by the respective player.

BACKGROUND ART

Throughout history people have spent a significant amount of their time conducting recreational activities such as playing games. The number of and types of games that exist are numerous, but of all games, the board game has been continuously played and improved upon.

A great benefit of board games is that they can be designed either very simply or complicated. Board games can also have themes, such as real estate, sports, etc. Some board games are developed for children while others are meant to be played by adults only.

One of the appealing aspects of playing board games is the sense of competition. People like healthy competition, especially when the winner receives some type of prize or reward. The most obvious example of this type of game, for adults, is gambling. For as long as there has existed some form of legal tender, there has been a desire to acquire more by wagering. The problem lies in the fact that most people who gamble end up losing everything they have in the effort to gain more.

A novel solution to this problem was to gamble with "chips" instead of real money. Unfortunately, many people also crave the ambience of a casino to provide the environment of a true gambling experience.

Therefore, if there was some type of board game that could faithfully reproduce the ambience of a gambling mecca, such as Las Vegas, while allowing players to gamble as part of the game, it would be extremely popular with both seasoned gamblers and those who simply enjoy gambling for the competition.

A search of the prior art did not disclose any patents that read directly on the claims of the instant invention however, the following U.S. patents were considered related:

| PATENT NO. | INVENTOR | ISSUED |
|---|---|---|
| D402,330 | White | December 8, 1998 |
| 4,998,736 | Elrod | March 12, 1991 |
| 4,787,639 | Ross | November 29, 1988 |
| 4,582,233 | Wilson | April 29, 1986 |

The D402,330 design patent discloses a gambling board game entitled "Gambler's Decathlon". The game allows a plurality of players to select and place a bet on either Black Jack, Roulette or Craps. After the bets are placed, a first player throws a pair of dice to determine any winners or losers.

The U.S. Pat. No. 4,998,736 discloses a game containing a board with multiple spaces on which a concert platform playing piece moves for each player from a start box to a final stage. Each space contains instructions which may include selecting a rescue or challenge card. The rescue cards provide a means for escaping precarious predicaments and the challenge cards may ask questions which if answered correctly provides a bonus and if answered incorrectly a monetary penalty. A pair of dice determines the number of spaces moved during each player's turn. Each player can obtain band members to be inserted on their playing piece. Such band members are worth $50,000 each at the conclusion of the game, when each player arrives at the final stage. The player who accumulates the most money is declared the winner.

The U.S. Pat. No. 4,787,639 discloses a game consisting of a game board, a multiple number of playing pieces shaped like musicians and their instruments, a multiple number of discs that receive flags with music note symbols, tokens, cards and a die. The game board consists of two separate paths, one representing the life of a rock musician and the other representing the position of a record on the charts. The winner of the game is the fist player to advance their discs to the number one space. The disc may be advanced by completing a circuit of the outer path with the token or by collecting a specified number of flags which are placed in the disk.

The U.S. Pat. No. 4,585,233 discloses a board game which is used in combination with a existing board game, such as MONOPOLY$^{(R)}$, to provide expanded and more complex game play. In a preferred embodiment, the game board has a recessed interior portion capable of receiving the existing board game. The surrounding outer game board contains a plurality of spaces having subject matter compatible with the subject matter of the spaces on the MONOPOLY$^{(R)}$ game board.

DISCLOSURE OF THE INVENTION

The competitive gambling board game also known as ZAKIT™, is designed to provide for at least two players a competitive game which embodies the ambiance of a Las Vegas type casino. The game combines personal trivia skills in combination with the rolling of a pair of dice. The players interact by placing bets on trivia questions and at each roll of the dice. In addition to rolling the dice, players can create additional money or lose money by selecting various cards. The money creating cards consist of "Character Possessions" and "You're So Money Honey", and the loss of money occurs when a player must choose a "No Jack Baby" card. The game also provides that if you run out of money and need additional funds, a player can pawn his/her possessions for a cash equivalent or receive a $500.00 loan from the house.

In its most basic structural design, the competitive gambling board game is comprises of:

a game board which includes: a plurality of Place Your Bets sections, Trivia Bet sections, a Pawn Shop a Character Possession section, and a plurality of sequential character movement spaces, including a start line and a finish line.

A set of implements used in combination with the game board to play the competitive gambling board game, the implements include:

a means for determining monetary values, a means for selecting a player sequence, a plurality of movable characters, a means for determining the number of character movement spaces a player is to take, a plurality of Character Possession cards, a plurality of Trivia cards, a plurality of Trivia chips, a plurality of You're So Money Honey cards, and a plurality of No Jack Baby cards.

The directions for playing the game are included in the Best Mode for Carrying Out the Invention section.

In view of the above disclosure, it is the primary object of the invention to provide a competitive, gambling board game that recreates the ambiance of a casino.

In addition to the primary object of the invention it is also an object of the invention to provide a board game that:

can be easily transported from one location to another, can be played by two or more players of various age groups, and is cost effective from both a consumer or a manufacturer point of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 13 is a written description of the character Three of a Kind.

FIG. 14 is a written description of the character The Queen of Hearts.

FIG. 15 is a written description of the character 2nd Hand Rose.

FIG. 16 is a written description of the character Father O'Slevin.

FIG. 17 is a written description of the character JD.

FIG. 18 is a written description of the character Big Jake.

FIG. 19 is a written description of the character Jimmy Bag O'Donuts.

FIG. 20 is a written description of the character Cookie Doll.

FIG. 21 is a written description of the character Schmokey.

BEST MODE FOR CARRYING OUT THE INVENTION

Figure 1:
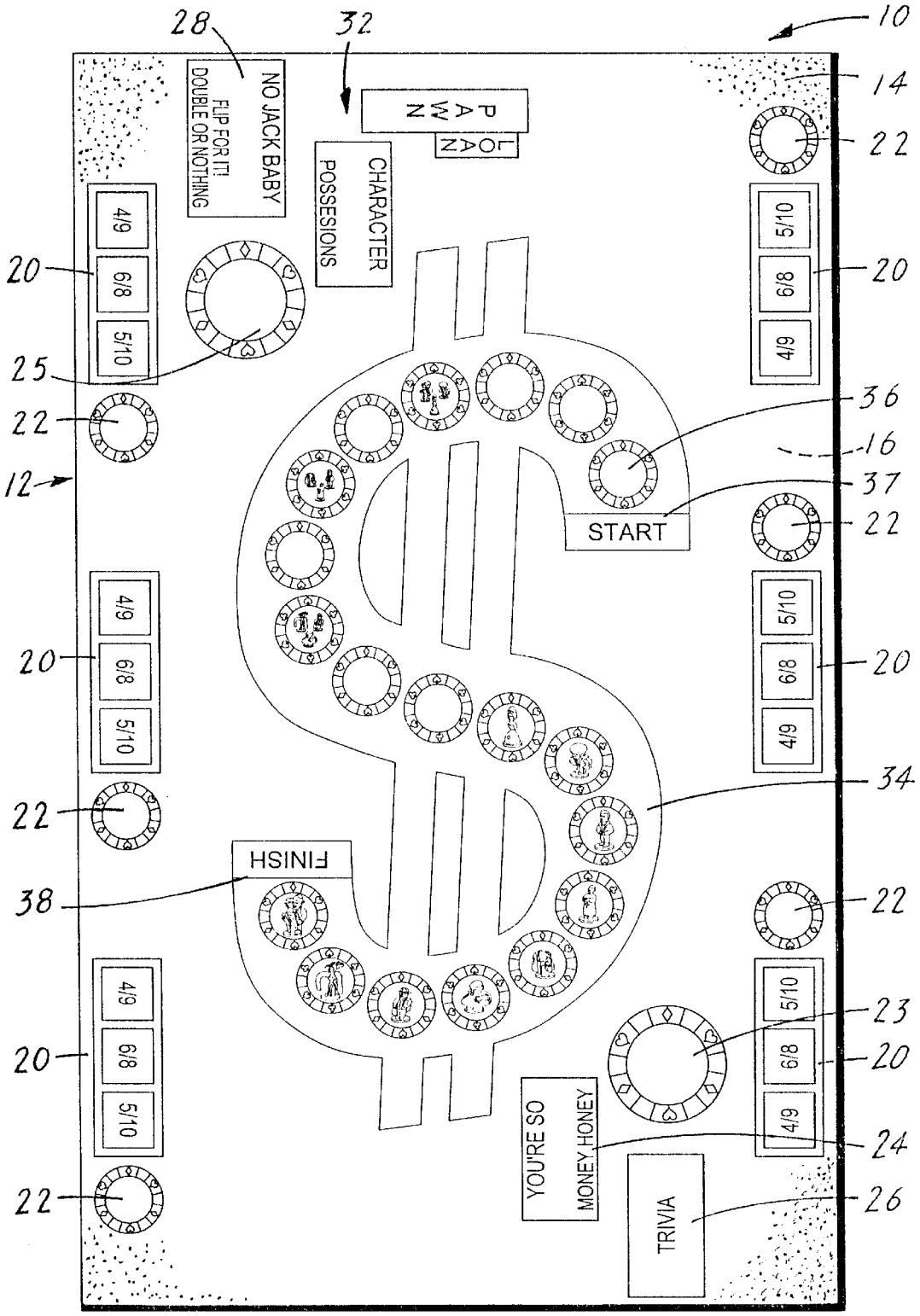
FIG. 1 is a plan view of the game board used when playing the competitive gambling board game.

The best mode for carrying out the invention is presented in terms of a preferred embodiment for a structure and method for playing a competitive gambling board game, also known as ZAKIT™. The game allows players to play against each other as well as against the "house", in an environment of a casino. The game 10, as shown in FIGS. 1–27, is comprised of the following major elements: a game board 12, monetary value determining means 40, player sequence means 44, player movement determining means 48, a set of characters 50, a plurality of character possession cards 52, a plurality of trivia cards 56, a plurality of trivia chips 58, a plurality of You're So Money Honey cars 62, and a plurality of No Jack Baby cards 64.

The game board 12, as shown in FIG. 1, consists of an upper surface 14 and a lower surface 16 and can be comprised of a single section or four separate sections. The four sections interface at their respective edges by a board attachment means, such as a frame (not shown). The game 10 is conducted upon the upper surface 14 of the board 12, and therefore, the upper surface 14 includes the following printed indicia: a plurality of Place Your Bets sections 20 having a plurality of betting boxes, which are located on two sides of the board; a plurality of Trivia Bet sections 22, which are located adjacent to the Place Your Bets sections 20; a ZAKIT™ or Bust Roll section 23; a You're So Money Money section 24; a No Jack Baby Flip for it section 25; a Trivia Challenge section 26; a No Jack Baby section 28; a Pawn Shop and Character Possession section 32; and a Dollar Sign section 34 which has a plurality of sequential character movement spaces 36 including a start line 37 and a finish line 38.

Figure 2:
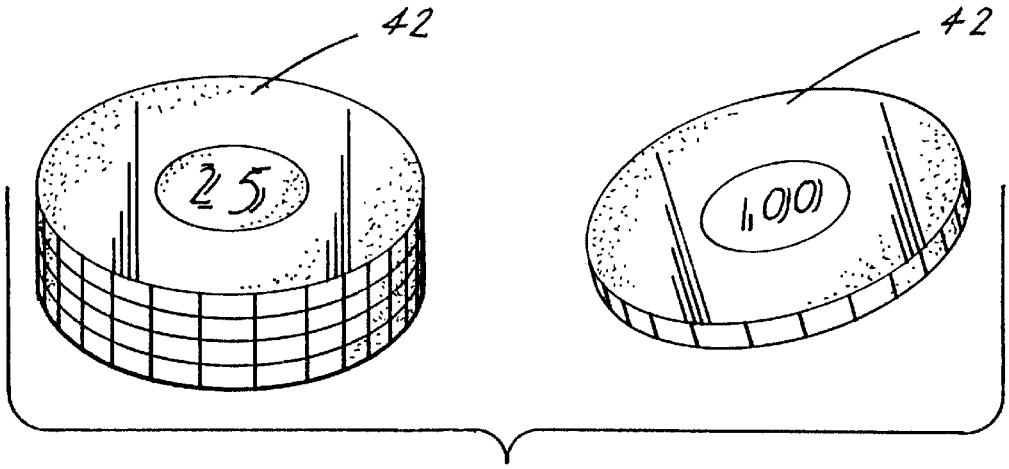
FIG. 2 is a perspective view of a group of gambling chips.
Figure 3:
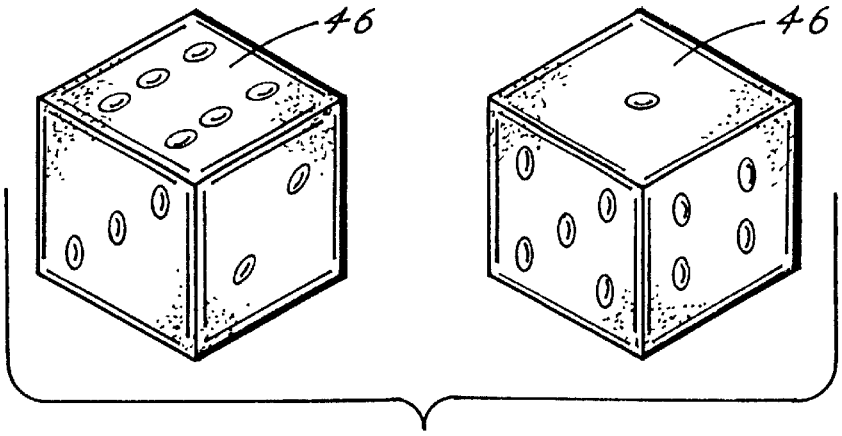
FIG. 3 is a perspective view of a pair of dice.

In order to lay the ZAKIT™ game 10, a set of implements are utilized in combination with the game board 12. The implements, as shown in FIGS. 2–27K, comprise the following: the monetary value determining means 40, as shown in FIG. 2, which is comprised of a multiplicity of gambling chips 42. Typically, the chips will include indicia that will indicate the monetary value of each chip, which can range from $25.00 to $500.00. The player sequence means 44 is comprised of a random number producing device, such as a single die 46 or a pair of dice 46, as shown in FIG. 3. The means for determining the number of character movement spaces a player is to take is also comprised of a random number producing device, such as a die or dice 46. Additionally, the player sequence means 44 and the character movement spaces determining means 48 may also be comprised of a base having a set of numbers and a centrally-attached, hand-spun needle that terminates its spin upon one of the set of numbers. This means can be designed to simulate the appearance of a roulette wheel. Further, an electronic random number generator may also be utilized.

In order to add a semblance of casino "style" to the game 10, each player chooses a character from the set of characters 50 before the start of the game. The player then uses his/her character to mover along the character movement spaces 36.

Figure 4:
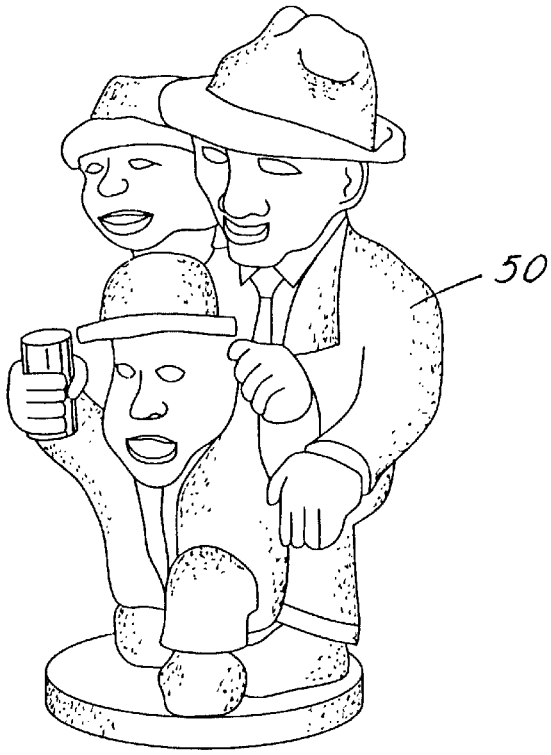
FIG. 4 is a perspective view of a character named Three of a Kind.
Figure 5:
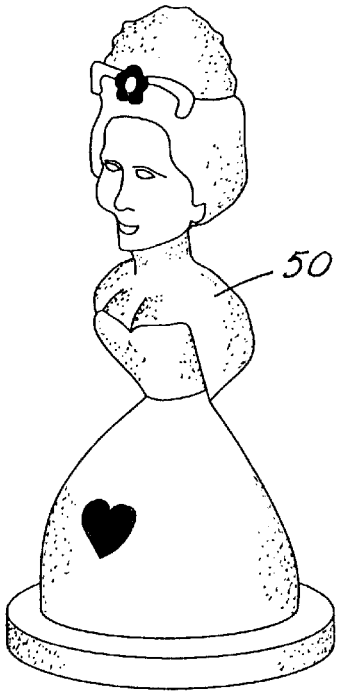
FIG. 5 is a perspective view of a character named The Queen of Hearts.
Figure 6:
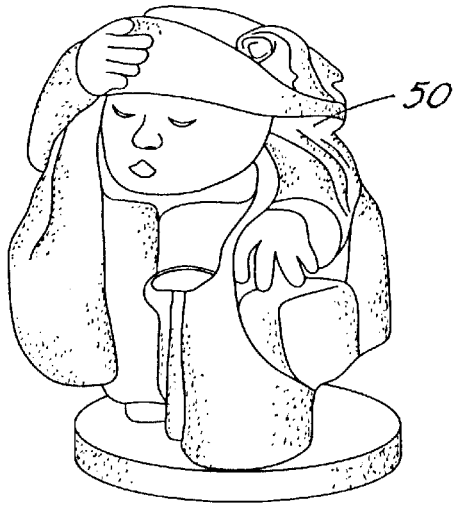
FIG. 6 is a perspective view of a character named 2nd Hand Rose.
Figure 7:
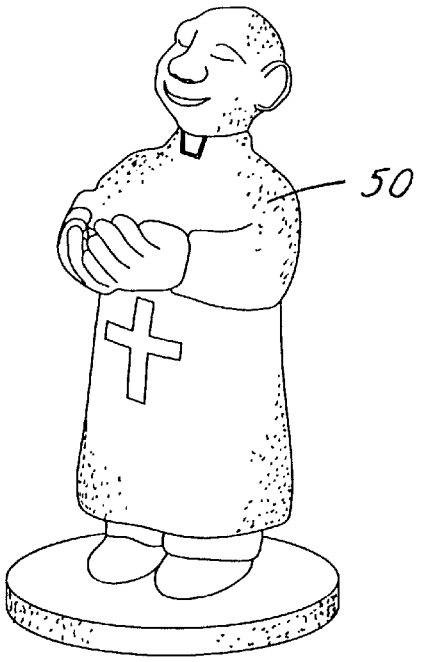
FIG. 7 is a perspective view of a character named Father O'Slevin.
Figure 8:
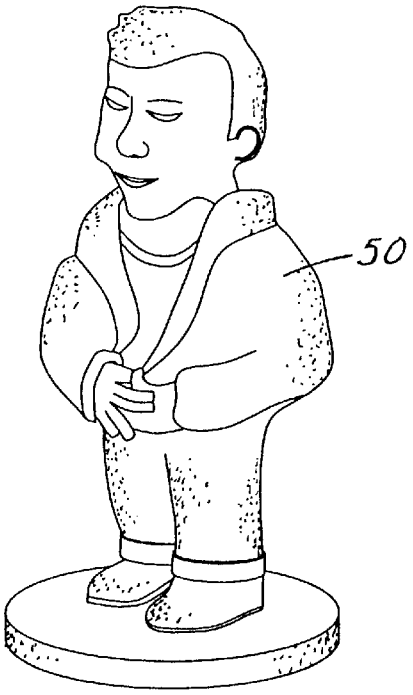
FIG. 8 is a perspective view of a character named JD.
Figure 9:
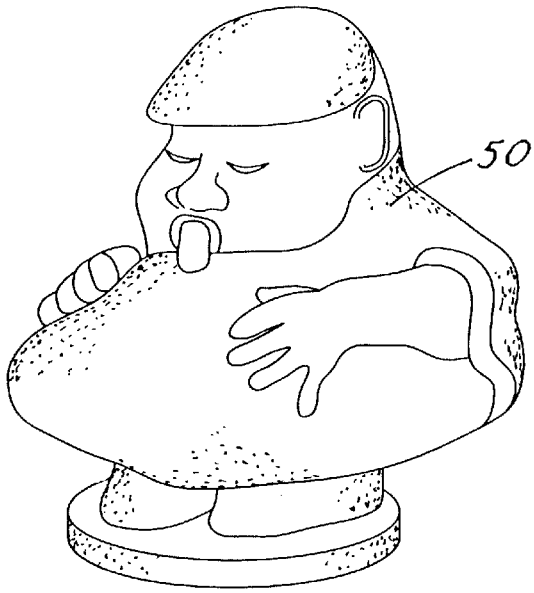
FIG. 9 is a perspective view of a character named Big Jake.
Figure 10:
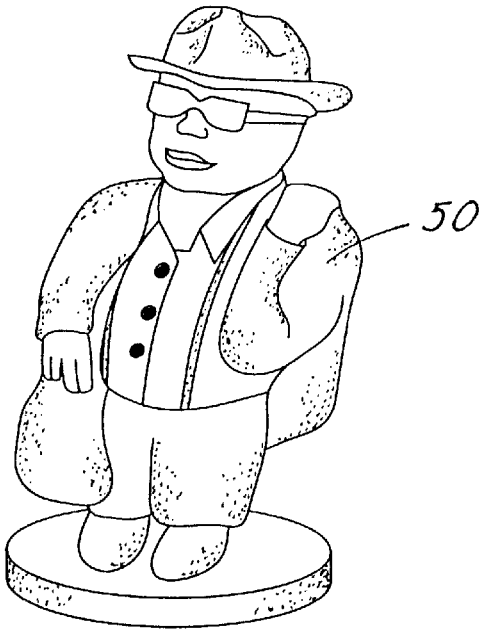
FIG. 10 is a perspective view of a character named Jimmy Bag O'Donuts.
Figure 11:
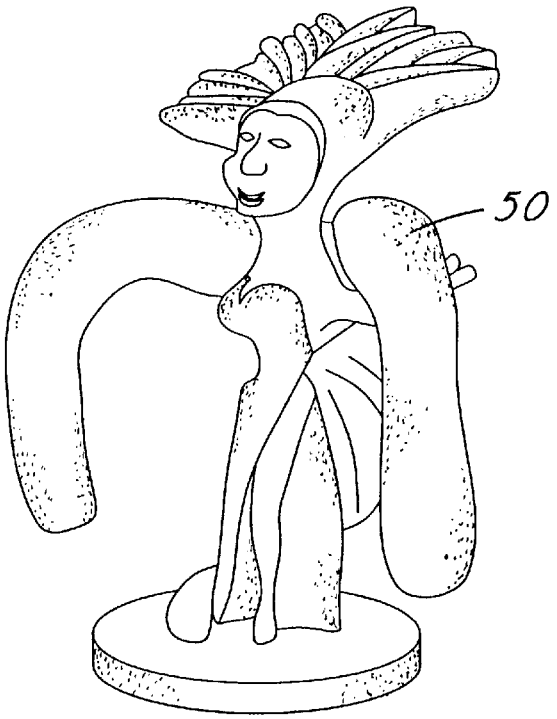
FIG. 11 is a perspective view of a character named Cookie Doll.
Figure 12:
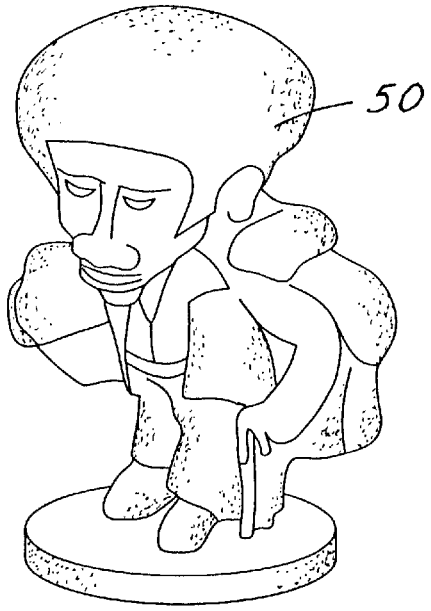
FIG. 12 is a perspective view of a character named Schmokey.

There are nine three-dimensional characters in the game 10, as follows: Three of a Kind, as shown in FIG. 4, The Queen of Hearts, as shown in FIG. 5; 2nd Hand Rose, as shown in FIG. 6; Father O'Slevin, as shown in FIG. 7; JD, as shown in FIG. 8; Big Jake, as shown in FIG. 9; Jimmy Bag O'Donuts, as shown in FIG. 10; Cookie Doll, as shown in FIG. 11; and Schmokey, as shown in FIG. 12. Each character 50 has seven character possession cards 52 with a combined value of $7,000.00, which are given to each player before the start of the game. The character possession cards 52 include items that are "owned" by each character and each item's individual worth. By accumulating character possession cards 52, a player can increase his/her monetary worth. A list of each character's possessions along with a short character biography is shown in FIGS. 13–21, in the same sequence as the characters 50 listed above. The character possession cards 52 include a picture of the respective character on one side, and one of the possessions and the possession's monetary value on the opposite site.

Figure 22:
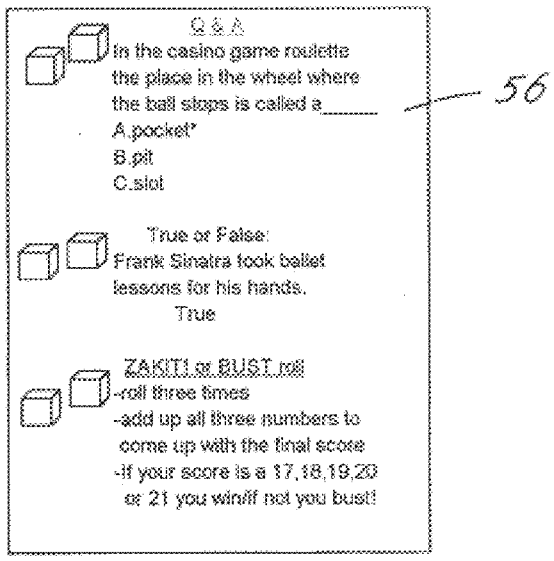
FIG. 22 is an elevational view of a typical Trivia Card of which there are a total 350 cards.

The plurality of Trivia Cards 56, with a typical card shown in FIG. 22, is comprised of 350 cards, with each card having three sections: a multiple choice question with several answers, including the correct answer indicated; a true or false question with the current answer given; and directions for a ZAKIT™ or Bust roll.

In the first section, which includes the question and answer, the question must be answered if a player rolls a 7 consisting of a 3 and a 4; in the second section is the true or false question, which must be answered if the rolled 7 consists of a 2 and 5; and in the third section is the ZAKIT™ or Bust roll, which must be selected if the rolled 7 consists of a 1 and 6.

Figure 23:
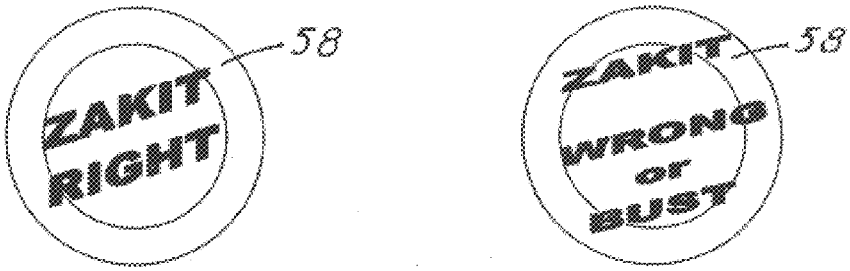
FIG. 23 is a plan view showing both sides of a Trivia Chip.
Figure 24:
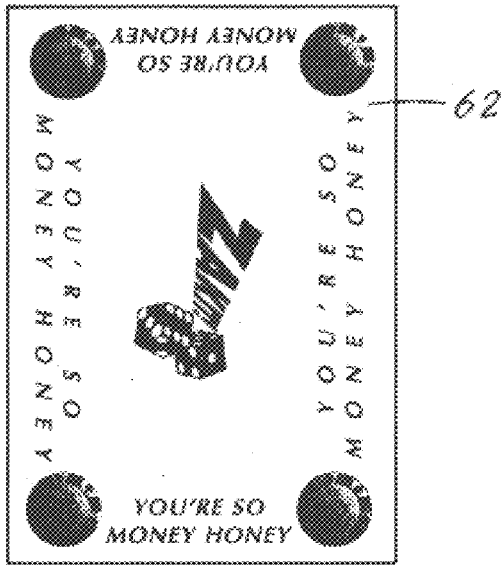
FIG. 24 is an elevational view of a front side of a You're So Money Honey card.
Figure 25A:
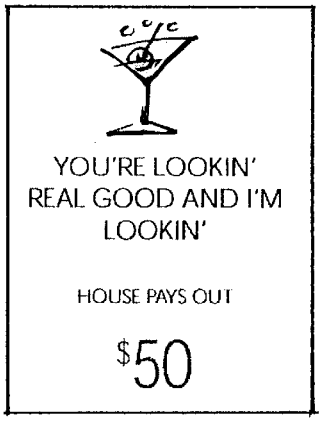
FIGS. 25A–25H are elevational views of the rear sides of the eight designs of the You're So Money Honey Cards of which there are a total of fifty cards.
Figure 25B:
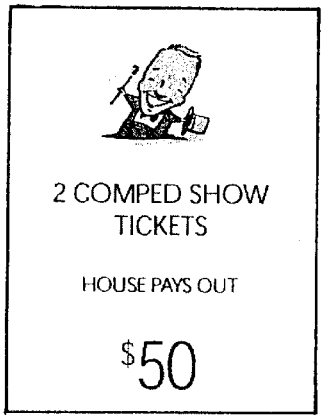
Figure 25C:
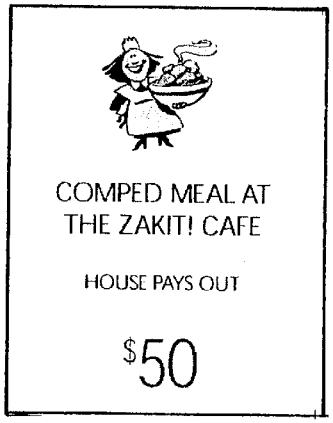
Figure 25D:
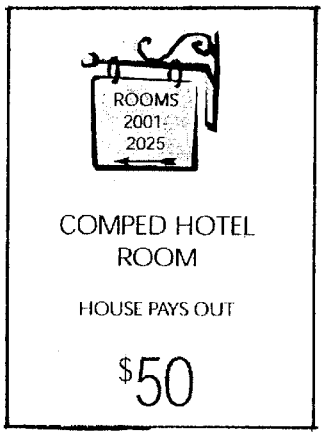
Figure 25E:
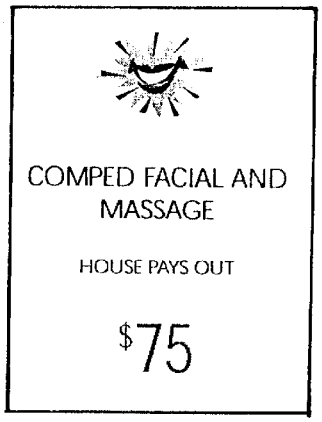
Figure 25F:
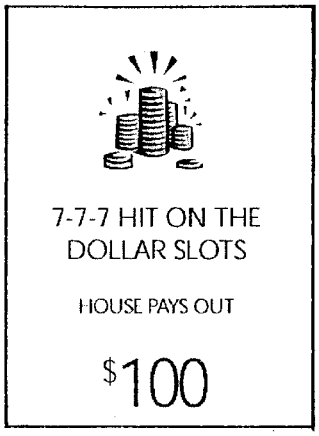
Figure 25G:
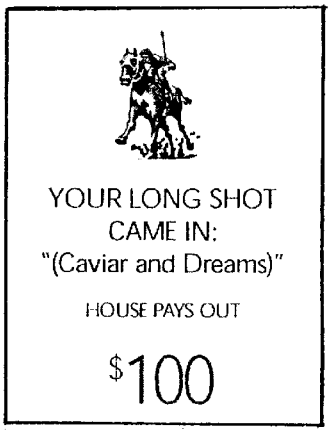
Figure 25H:
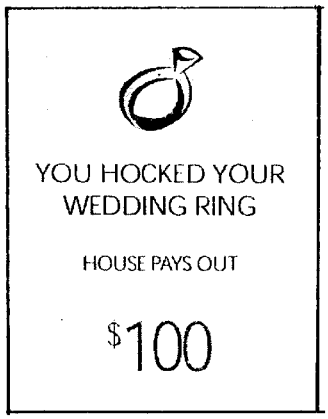

Each player receives one of the Trivia chips 58, as shown in FIG. 23, which are used by the players to bet on whether or not an individual player will answer a Trivia question correctly or incorrectly, and the outcome of the ZAKIT™ or Bust Roll. The upper surface of the chip 58 is imprinted with the words "RIGHT", and the lower surface is imprinted with the words "WRONG or BUST".

The You're So Money Honey cards 62 are shown in FIGS. 24 and 25A–25H. There are 50 cards total, with eight different designs. One side of the card 62 has the words "You're So Money Honey" imprinted thereon, as shown in FIG. 23. The other side of the card shows a small illustration, a message and a monetary value which can be $25.00, $50.00 or $100.00, depending on each respective card.

Figure 26:
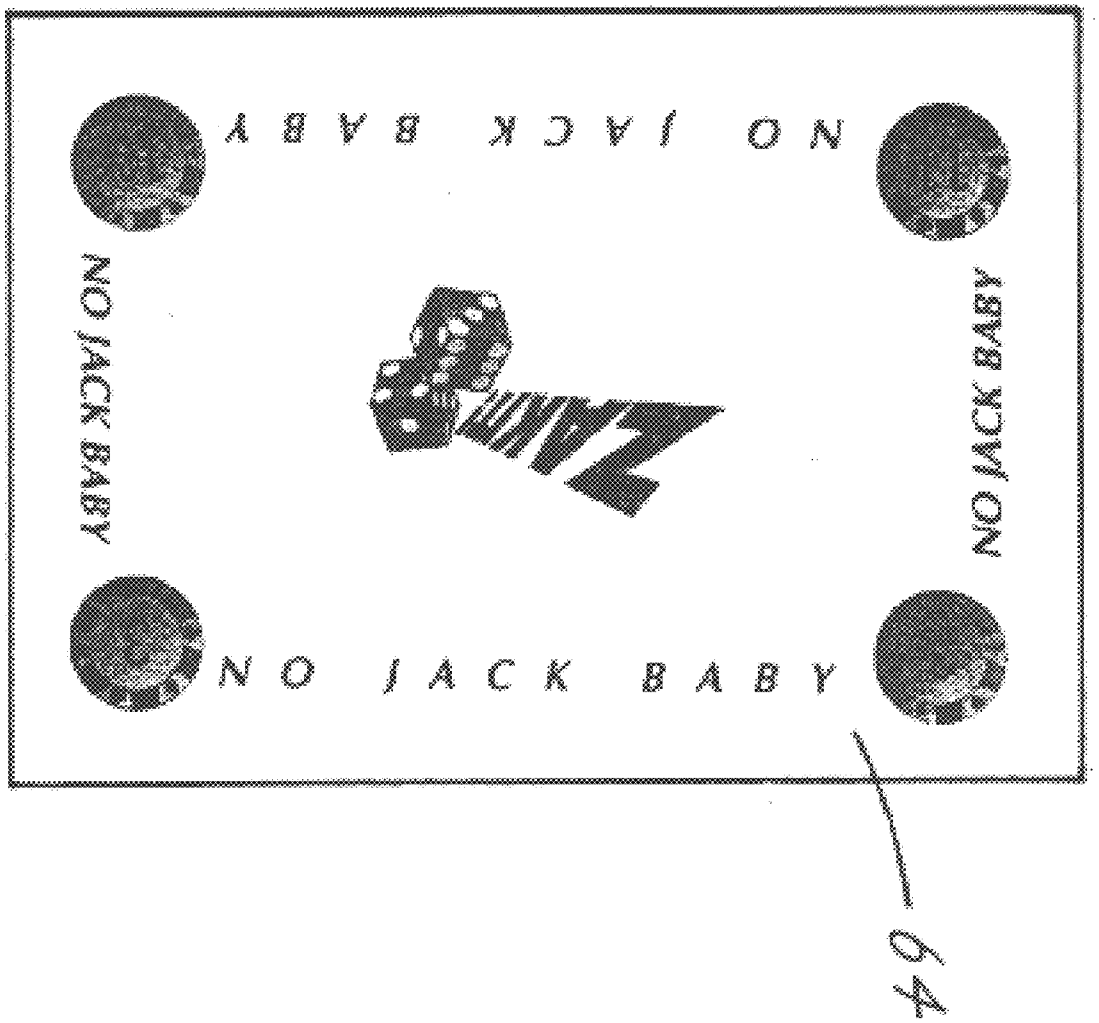
FIG. 26 is an elevational view of a front side of a No Jack Baby card.
Figure 27A:
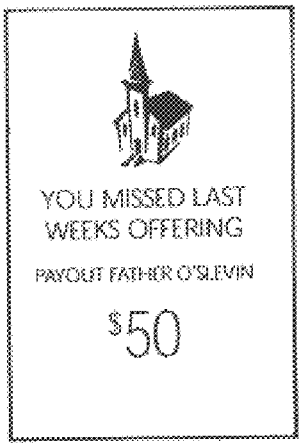
FIGS. 27A–27K are elevational views of the rear side of the eleven designs of the No Jack Baby cards of which there are a total of fifty cards.
Figure 27B:
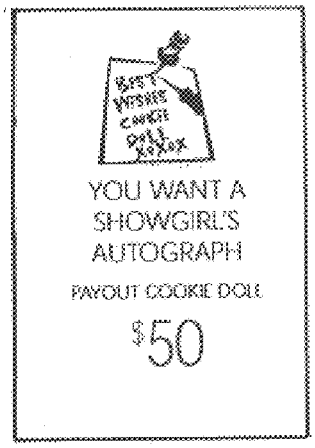
Figure 27C:
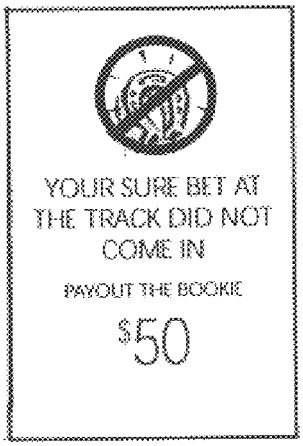
Figure 27D:
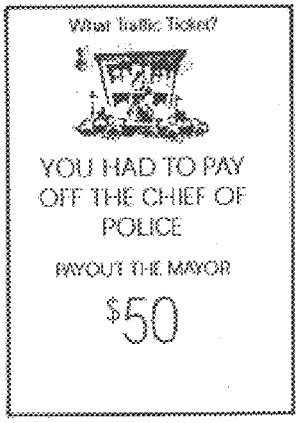
Figure 27E:
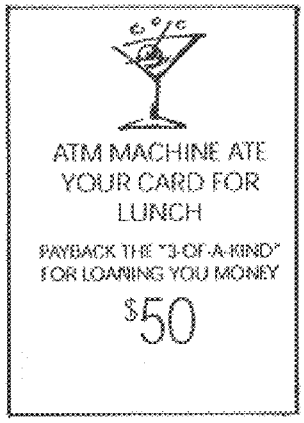
Figure 27F:
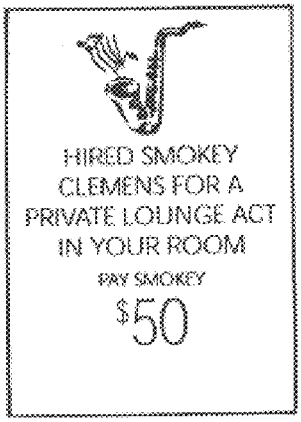
Figure 27G:
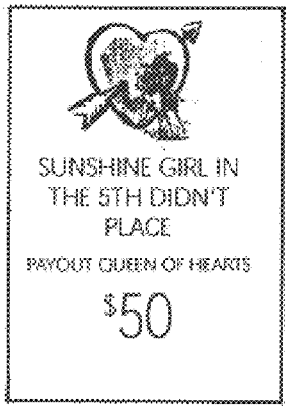
Figure 27H:
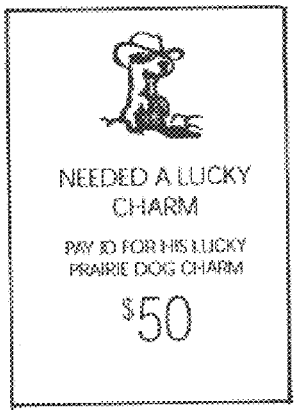
Figure 27I:
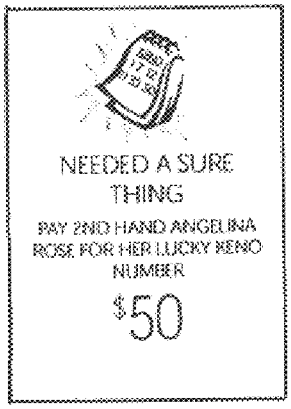
Figure 27J:
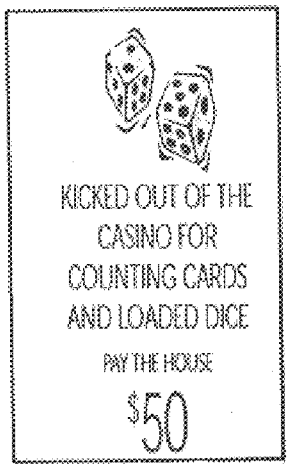
Figure 27K:
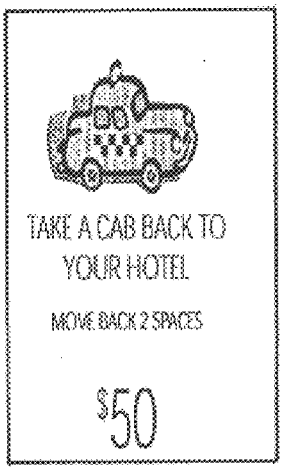

The No Jack Baby cards 64 are shown in FIGS. 26 and 27A–27K. There are 50 cards total, with 11 different designs. The No Jack Baby cards 64 are similar to the You're So Money Honey cards 62. One side of the card 64 has the words "No Jack Baby" imprinted thereon, as shown in FIG. 26. The other side of the card shows a small illustration, a message and a monetary fine of $50.00, which is the fine on all No Jack Baby cards 64, except card 27K, which instructs the player to move back two spaces.

The game 10 is played by performing the following steps:

1) Select a first player, from at least two players, by the player selecting means, wherein one of the players is designated the pit boss.
2) Have each player select a character.
3) Have the first player roll the dice, if the rolled number results in either a 4, 5, 6, 8, 9 or 10 a point number is established; once the point number is established, the other players can place their bets on their respective betting boxes having the established number and/or other box betting numbers.
4) Have the first player roll the dice a second time:
   a. if the established point number or the betting box number is rolled, the house pays the winning bets, the first player advances their character the amount of spaces equal to the rolled established point and selects a character possession card pertaining to the landed character, after which the first player's turn is over and the dice are passed to the next player where the dice are again rolled as stated in step 3.
   b. if the first player's first or any subsequent roll results in a 7, a Trivia question can be selected; each of the other players then remove their bets from their respective "Place Your Bets" section, place their Trivia Chip with either the "right" or "wrong or bust" side facing upward and place their bet, atop the chip,
   c. if the first player elects to answer the Trivia question and it is answered correctly all players who had their bets placed atop the "right" side of the trivia chip are paid by the pit boss, the player having their bets atop the "wrong or bust" side of the Trivia Chip lose their bets; the first player is also paid, their character moves two spaces, a character possession from the landed character is selected and the first player has an option of placing a bet on a bonus round; the first player then rolls the dice three times, adds the total to determine a final total, if the total is 17, 18, 19, 20 and 21 then the player wins and is paid by the pit boss, the first player moves their character two spaces and selects a possession from the landed character, if the score is 16 or under or 22 and over the first player losses the bet,
   d. if the Trivia question is answered incorrectly all players having their bets on the "wrong or bust" side of the trivia chip win their bets, the first player looses and then passes the dice to one of the other players and the game continues,
   e. if a ZAKIT™ or Bust roll is selected by the first player, all the other players who have not placed a bet must place a bet on either the "right" side or the "wrong or bust" side of the Trivia Chip, the first player then rolls the dice three times, adds the total to determine a final total, if the total is 17, 18, 19, 20 or 21 then all players bets placed on the "right" side of the Trivia Chip win and are paid by the pit boss, the player moves their character two spaces and selects a character possession from the landed character; if the total is 16 or under, or 22 and over the other player's loose their bets and all the players bets that were placed on the "right" side of the Trivia Chip also loose their bets; the player's bets that were placed on the "wrong or bust" side of the Trivia Chip, win the round and are paid by the pit boss,
   f. if a 2 or a 12 is rolled, including the first roll when a point is being established, a You're So Money Honey card is selected, and the dollar value of the card is paid to the player by the pit boss, the player then continues to roll for their point or any of the box numbers, and
   g. if a 3 or 11 is rolled, including the first roll when a point is being established, a No Jack Baby card is selected, and the value shown on the card is paid to whomever is listed on the card, the player paid has a choice to flip a coin for a double or nothing bet, the game is completed when any of the players crosses the finish line on the game board, the player who has accumulated the most money at that time wins the game.

The gambling board game 10 is disclosed supra in terms of a conventional board game. However, the game 10 is also amenable for being designed with software that operates a compact disc which allows the game to be played on a personal computer or other compact disc viewing equipment. Additionally, the game 10 can be designed to be played on the internet which allows a plurality of remote players to interface in real time.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

What is claimed is:

1. A method for playing a competitive gambling board game played by at least two players and comprising the following steps:

A provide a game board having an upper surface and a lower surface, wherein on the upper surface is printed:
- a) plurality of Place Your Bets sections,
- b) a plurality of Trivia Bet sections,
- c) a You're so Money Honey section,
- d) a Trivia challenge section,
- e) a No Jack Baby section,
- f) a Character Possession section,
- g) a Pawn Shop section, and
- h) a Dollar Sign section having a plurality of sequential character movement spaces, B. provide the following which are used in combination with said game board to play said competitive gambling board game;
- a) a plurality of monetary chips,
- b) a pair of dice,
- c) a plurality of You're So Money Honey cards,
- d) a set of nine three-dimensional, stand-up Characters,
- e) a plurality of Character Possession cards,
- f) a plurality of Trivia cards,
- g) a plurality of Trivia chips, and
- h) a plurality of No Jack Baby cards, C. Commence the game by performing the following steps:
- a) select a first player, from at least two players, by a player selecting means, wherein one of the players is designated a pit boss,
- b) have each player select a character,
- c) have the first player roll the dice, if the rolled number results in either a 4, 5, 6, 8, 9 or 10 a point number is established, once the point number is established, the other players can place their bets on their respective betting boxes having the established number and/or other box betting numbers,
- d) have the first player roll the dice a second time;
  - (1) if the established point number or a box number is rolled, the house pays the winning bets,
  - (2) the first player advances their character the amount of spaces equal to he rolled point and selects a character possession card pertaining to the landed character, after which the first player's turn is over and the dice are passed to the next player where the dice are again rolled as stated in step C.b) and C.c),
  - (3) if the first player's first or second roll results in a 7, a trivia question or the ZAKIT or Bust roll can be selected, each of the other players then remove their bets from their respective "Place Your Bets" section, place a trivia chip with either a "right" or "wrong" side facing upward and place their bet, atop the chip,
  - (a) if the first player elects to answer the trivia question and it is answered correctly all players who had their bets placed atop the "right" side of the trivia chip are paid by the pit boss, the player having their bets atop the "wrong" side of the trivia chip lose their bets, the first player is also paid, their character moves two spaces, a character possession from the landed character is selected and the first player has an option of placing a bet on a ZAKIT or Bust bonus round, the first player then rolls the dice three times, adds the total to determine a final total, if the total is 17, 18, 19, 20 or 21 then the player wins and is paid by the pit boss, the first player moves their character two spaces and selects a possession from the landed character, if the score is 16 or under 22 and over the first player losses the bet,
  - b) if the trivia question is answered incorrectly all players having their bets on the "wrong" side of the trivia chip win their bets, the first player looses and then passes the dice to one of the other players and the game continues,
  - c) if a ZAKIT or Bust roll is selected by the first player all the other players who have not placed a bet must place a bet on either the "right" side or the "wrong" side of the Trivia Chip, the first player then rolls the dice three times, adds the total to determine a final total, if the total is 17, 18, 19, 20 or 21 then all player's bets placed on the "right" side of the Trivia Chip win and are paid by the pit boss, the player moves their character two spaces and selects a character possession from the landed character, if the total is 16 or under, or 22 and over the other player's loose their bets and all the players bets that were placed on the "right" side of the Trivia Chip also loose their bets, the player's bets that were placed on the "wrong" side of the Trivia Chip, win the round and are paid by the pit boss,
  - (d) if a 2 or a 12 is rolled, including the first roll when a point is being established, a You're so Money Honey card is selected, and the dollar value of the card is paid to the player by the pit boss, the player then continues to roll for their point or any of the box numbers, and
  - (e) if a 3 or 11 is rolled, including the first roll when a point is being established, a No Jack Baby card is selected, and the value shown on the card is paid to whomever is listed on the card, the player pad has a choice to flip a coin for a double or nothing bet, the game is completed when any of the players crosses the finish line on the game board, the player who has accumulated the most money at that time wins the game.

2. The method as specified in claim 1 wherein said game board is comprised of four separate sections by a frame dimensioned to frictionally hold the four separate sections in place.

3. The method as specified in claim 1 wherein said plurality of You're So Money Honey cards is comprised of 50 cards, with 8 different designs, wherein each said card includes the following information:
- a) a message,
- b) a monetary value, and
- c) an illustration.

4. The method as specified in claim 1 wherein said plurality of Character possession cards is comprised of 63 cards, wherein each said card includes the following information:

a) the name of a possession, b) the possession's monetary value, and c) a picture of the character who owns the possession.

5. The method as specified in claim 1 wherein said plurality of Trivia Cards is comprised of 350 cards, with each card having two questions, wherein each said card includes three sections; wherein the first section includes a question and an answer, wherein the question must be answered if a player rolls a 7 consisting of a 3 and a 4; the second section includes a true or false question which must be answered if the rolled 7 consists of a 2 and 5; and the third section is a ZAKIT or Bust roll which must be selected if the rolled 7 consists of a 1 and 6.

6. The method as specified in claim 1 wherein said plurality of Trivia Chips is comprised of at least two chips, wherein each said chip includes the following information:

a) upper surface—"Right" and b) lower surface—"wrong" or "bust".

7. The method as specified in claim 1 wherein said plurality of No Jack Baby cards is comprised of 50 cards, with 11 different designs, wherein each said card includes the following:

a) a message, b) a monetary value of $50.00 and c) an illustration.

* * * * *